US011066883B2

(12) United States Patent
Holmberg

(10) Patent No.: US 11,066,883 B2
(45) Date of Patent: Jul. 20, 2021

(54) HYDRAULIC DISCONNECT TOOL

(71) Applicant: Thru Tubing Solutions, Inc., Oklahoma City, OK (US)

(72) Inventor: Aaron Holmberg, Oklahoma City, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 486 days.

(21) Appl. No.: 15/552,138

(22) PCT Filed: Feb. 18, 2016

(86) PCT No.: PCT/US2016/018481

§ 371 (c)(1),
(2) Date: Aug. 18, 2017

(87) PCT Pub. No.: WO2016/134151

PCT Pub. Date: Aug. 25, 2016

(65) Prior Publication Data

US 2018/0045005 A1 Feb. 15, 2018

Related U.S. Application Data

(60) Provisional application No. 62/117,791, filed on Feb. 18, 2015.

(51) Int. Cl.
*E21B 23/00* (2006.01)
*E21B 17/06* (2006.01)
(Continued)

(52) U.S. Cl.
CPC ..... *E21B 23/00* (2013.01); *E21B 17/043* (2013.01); *E21B 17/06* (2013.01); *E21B 23/02* (2013.01)

(58) Field of Classification Search
CPC ..... E21B 17/043; E21B 17/06; E21B 23/00; E21B 23/02
See application file for complete search history.

(56) References Cited

U.S. PATENT DOCUMENTS 3,895,829 A * 7/1975 Manson, Jr. ..... E21B 17/043 285/3
5,082,061 A * 1/1992 Dollison ..... E21B 17/06 166/115

(Continued)

OTHER PUBLICATIONS

PCT/US2016/018481; International Search Report and Written Opinion; dated Apr. 28, 2016; 17 pages.

*Primary Examiner* — Christopher J Sebesta
(74) *Attorney, Agent, or Firm* — Hall Estill Law Firm

(57) ABSTRACT

A hydraulic disconnect tool that includes a lug retaining sleeve, the lug retaining sleeve having an upper portion, a base portion and a lower portion. The tool also includes at least one primary prong for engaging at least one primary prong receiver disposed in a latch housing. Furthermore, the hydraulic disconnect tool can includes at least one secondary prong for selectively engaging at least one secondary prong receive disposed in the latch housing when the at least one primary prong fails to properly engage the at least one primary prong receiver and a prop slidably disposed in the lug retaining sleeve, preload sleeve and the latch housing. Fluid can be pumped into and through the hydraulic disconnect tool and the latch housing can be disengaged from the lug retaining sleeve.

21 Claims, 7 Drawing Sheets

(51) Int. Cl.
*E21B 17/043* (2006.01)
*E21B 23/02* (2006.01)

(56) References Cited

U.S. PATENT DOCUMENTS

| | | | | |
|---|---|---|---|---|
| 2003/0062169 | A1* | 4/2003 | Marshall | E21B 31/00 166/377 |
| 2009/0025940 | A1 | 1/2009 | Rytlewski | |
| 2010/0175870 | A1 | 7/2010 | Benton et al. | |
| 2011/0308784 | A1* | 12/2011 | Ollerenshaw | E21B 17/06 166/72 |
| 2014/0110129 | A1 | 4/2014 | Schmidt | |
| 2014/0124220 | A1* | 5/2014 | Stautzenberger | E21B 23/006 166/381 |
| 2016/0273290 | A1* | 9/2016 | Harms | E21B 23/02 |

* cited by examiner

HYDRAULIC DISCONNECT TOOL

BACKGROUND OF THE DISCLOSURE

1. Field of the Invention

The present disclosure relates to a hydraulic disconnect tool to allow for a drill string and other downhole tools disposed in a bottom hole assembly (BHA) to be disconnected from any downhole tools that get stuck in a wellbore.

2. Description of the Related Art

Historically, hydraulic disconnect tools can fracture under certain circumstances in a wellbore. The fracture can cause certain parts of the hydraulic disconnect tool to not operate properly and fail to perform part of their intended function, which is to maintain connection to other downhole tools disposed below the hydraulic disconnect tools in a bottom hole assembly (BHA). If the current hydraulic connect tools completely fractures it would fail to maintain connection to the downhole tools in the BHA, thus leaving all tools disposed below the fractured hydraulic disconnect tool in the wellbore requiring a fishing operation to retrieve the downhole tools left in the wellbore.

Accordingly, there is a need for a hydraulic disconnect tool designed to withstand downhole operation conditions, but still maintain connection to the downhole tools disposed below the hydraulic disconnect tool and be able to withdraw these downhole tools after the hydraulic disconnect tool fractures.

SUMMARY OF THE DISCLOSURE

This disclosure is directed to a hydraulic disconnect tool that includes a lug retaining sleeve, the lug retaining sleeve having an upper portion, a base portion and a lower portion. The tool also includes at least one primary prong for engaging at least one primary prong receiver disposed in a latch housing. Furthermore, the hydraulic disconnect tool can includes at least one secondary prong for selectively engaging at least one secondary prong receive disposed in the latch housing when the at least one primary prong fails to properly engage the at least one primary prong receiver and a prop slidably disposed in the lug retaining sleeve, preload sleeve and the latch housing.

The disclosure is also directed toward a method of using the hydraulic disconnect tool described herein. The method includes pumping fluid into and through the hydraulic disconnect tool and disengaging the latch housing from the lug retaining sleeve.

DETAILED DESCRIPTION OF THE DISCLOSURE

Figure 1A:
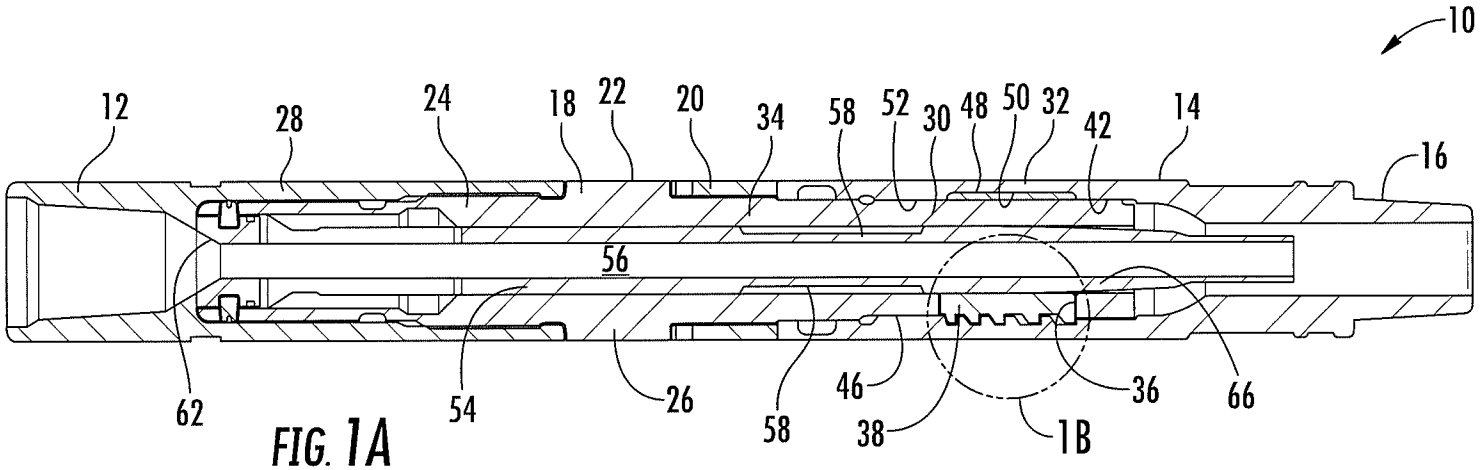
FIG. 1 is a cross-section view of a hydraulic disconnect tool constructed in accordance with the present disclosure.
Figure 1B:
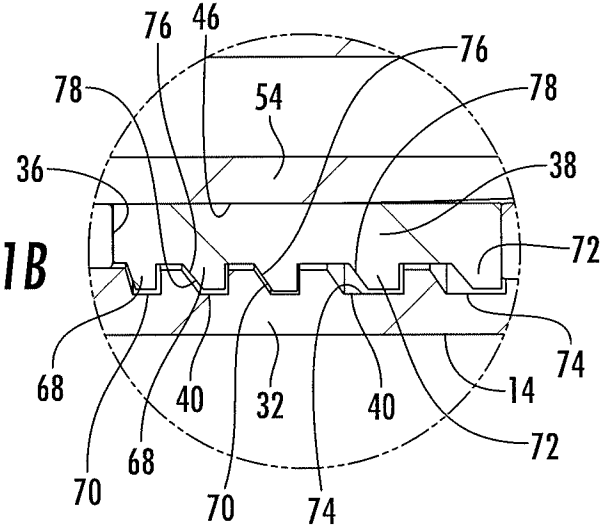
Figure 2:
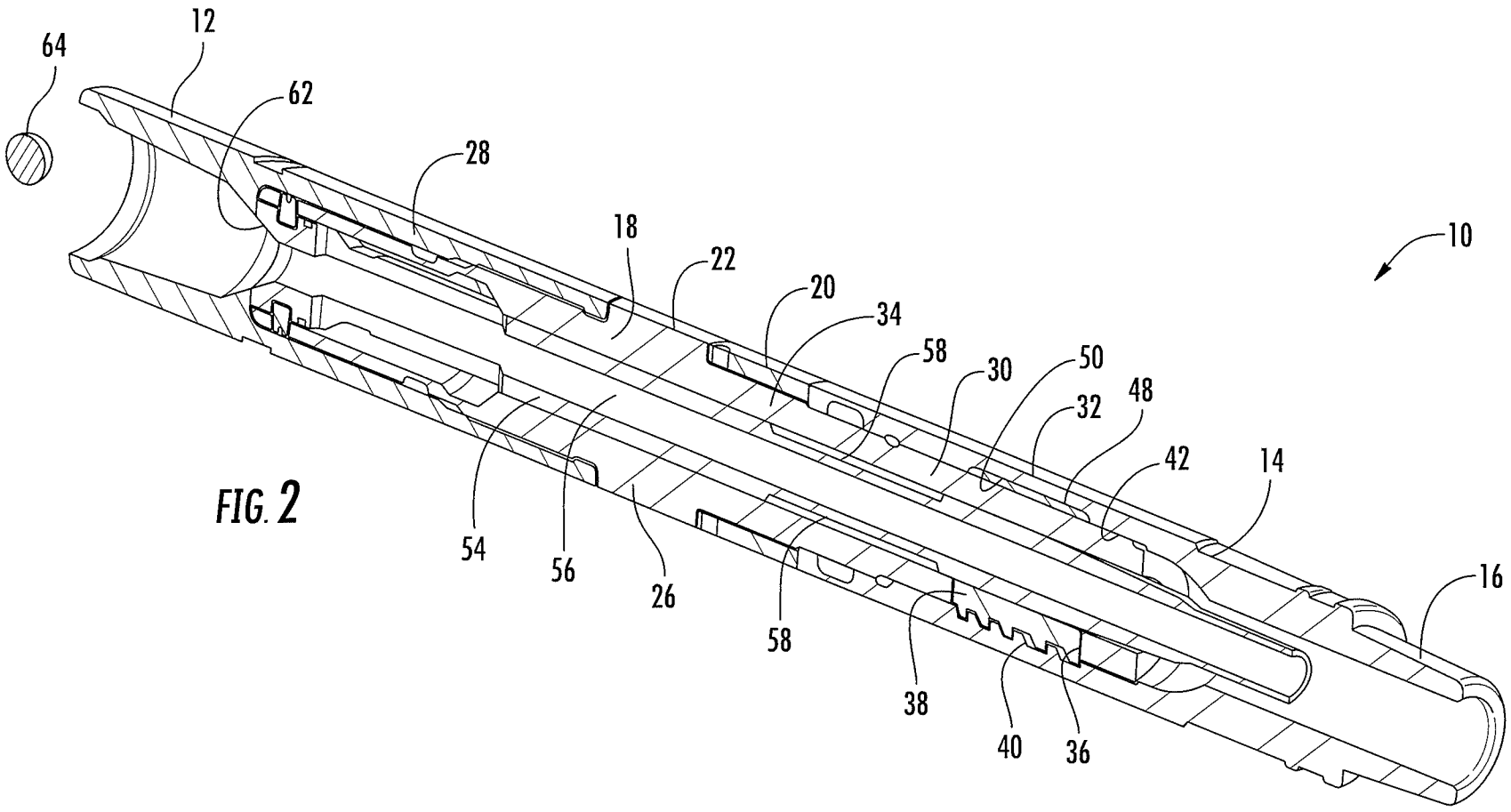
FIG. 2 is a perspective, cross-sectional view of the hydraulic disconnect tool in a propped position and constructed in accordance with the present disclosure.
Figure 3:
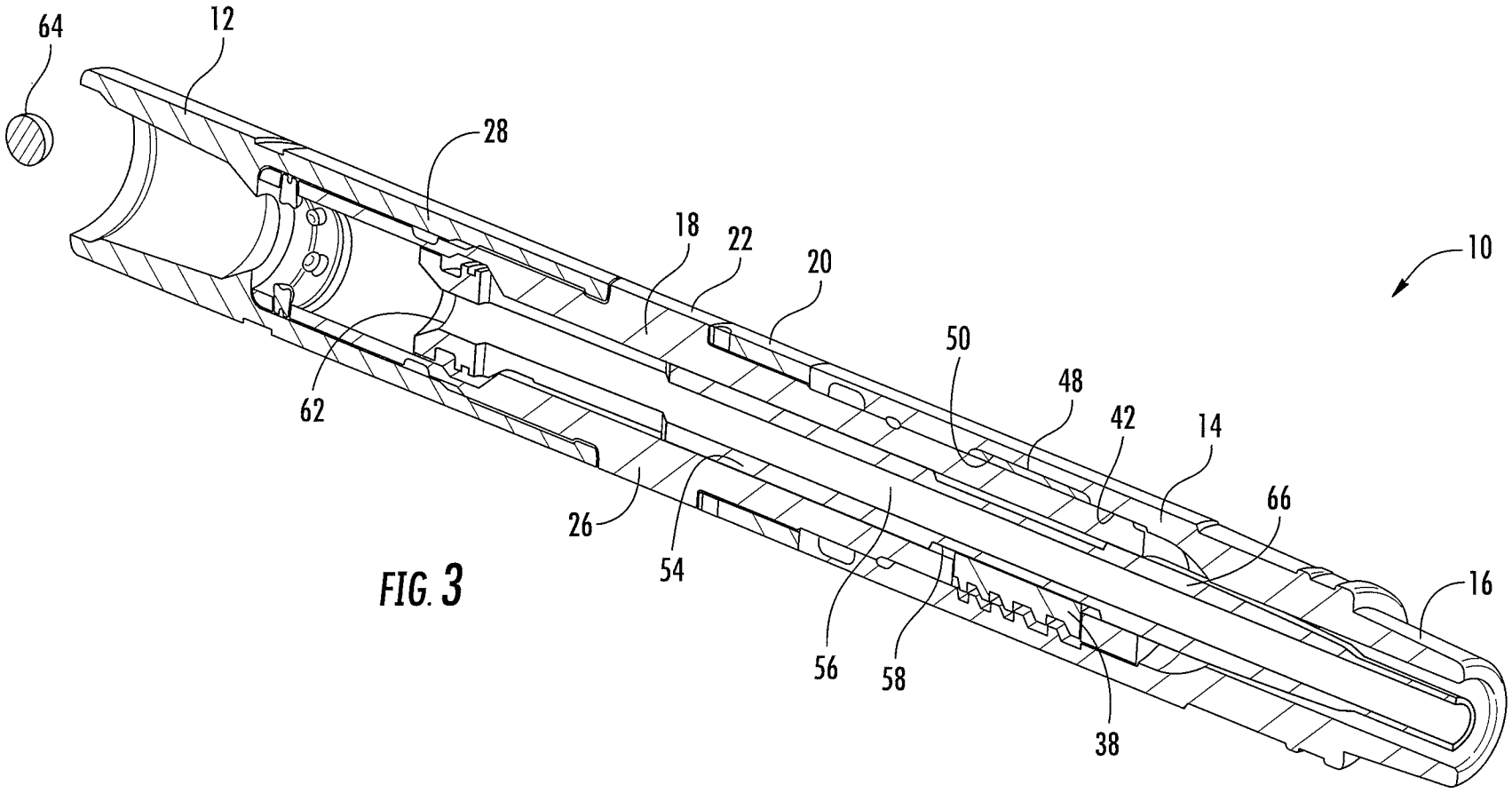
FIG. 3 is a perspective, cross-sectional view of the hydraulic disconnect tool in an unpropped position and constructed in accordance with the present disclosure.
Figure 4:
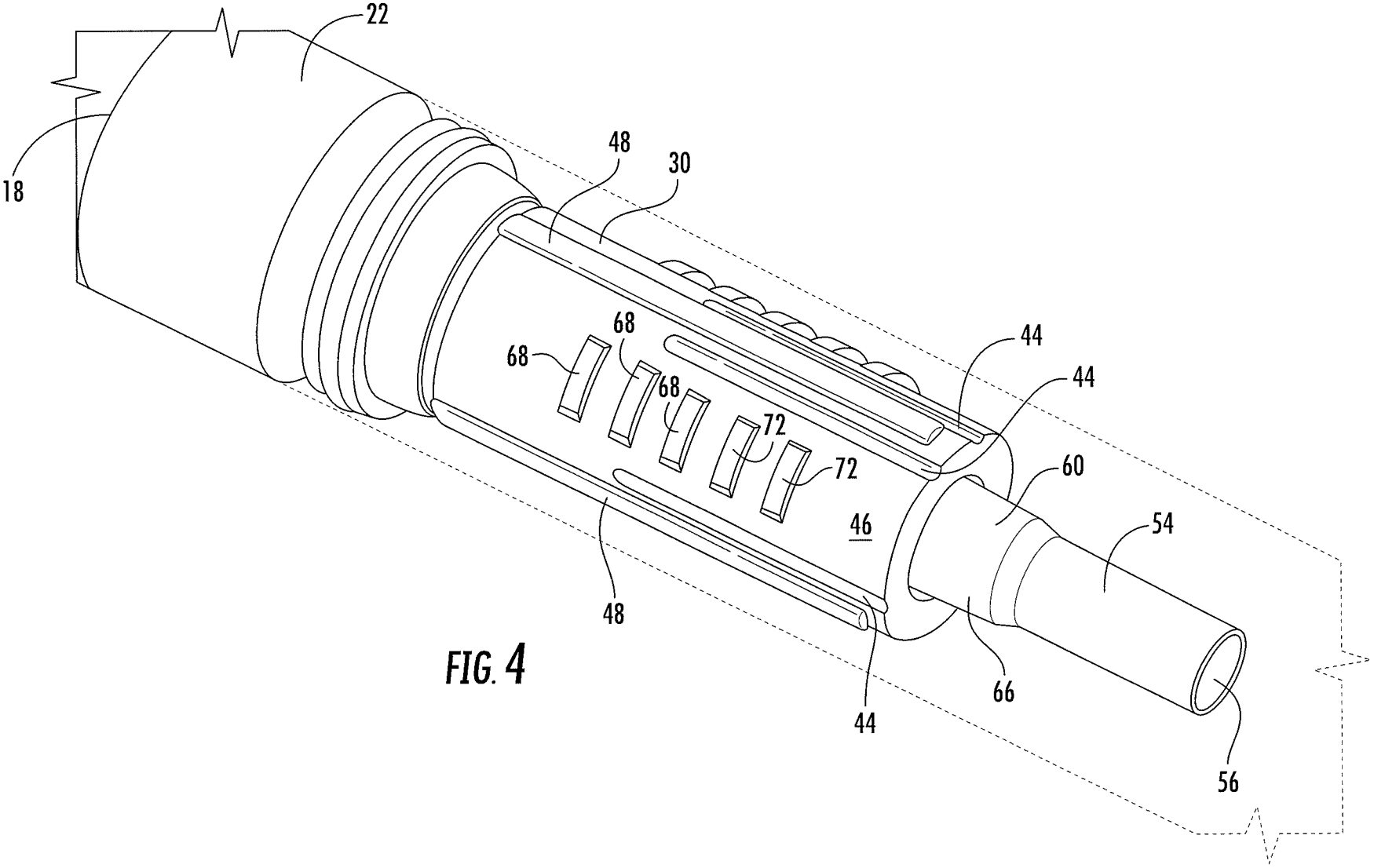
FIG. 4 is a perspective view of a lower portion of the hydraulic disconnect tool constructed in accordance with the present disclosure.

The present disclosure relates to a hydraulic disconnect tool 10 that can better withstand various operating conditions, such as in use with a vibratory or agitator tool, and still be able to effectively operate as a hydraulic disconnect tool. The hydraulic disconnect tool 10 includes a top sub 12 for connecting the hydraulic disconnect tool 10 to other tools disposed above the hydraulic disconnect tool 10 in a bottom hole assembly (BHA) and a latch housing 14 having a bottom sub portion 16 for connecting the hydraulic disconnect tool 10 to other tools disposed below the hydraulic disconnect tool 10 in the BHA. The hydraulic disconnect tool 10 also includes a lug retaining sleeve 18 disposed adjacent to the top sub 12 and a preload sleeve 20 disposed between an outer portion 22 of the lug retaining sleeve 18 and adjacent to the latch housing 14. The preload sleeve 20 eliminates slack and reduces the need for tight machining tolerances for the parts of the hydraulic disconnect tool 10. Furthermore, the preload sleeve 20 will eliminate differential acceleration of components of the hydraulic disconnect tool 10.

The lug retaining sleeve 18 has an upper portion 24 that extends in the uphole direction from a base portion 26 of the lug retaining sleeve 18 inside a receiving portion 28 of the top sub 12 and a lower portion 30 that extends into an extended portion 32 of the latch housing 14. The preload sleeve 20 is disposed around an upper part 34 of the lower portion 30 of the lug retaining sleeve 18. The preload sleeve 20 can be threaded on to the upper part 34 of the lower portion 30 of the lug retaining sleeve 18. The lower portion 30 of the lug retaining sleeve 18 includes at least one radial directed opening 36 for receiving a lug 38. The extended portion 32 of the latch housing 14 that accepts the lower portion 30 of the lug retaining sleeve 18 includes a depression area 40 disposed on an inside portion 42 to engage with the lug 38 disposed in the radial directed opening 36 in the lug retaining sleeve 18.

In another embodiment, the lower portion 30 of the lug retaining sleeve 18 can also include at least one fluid course 44 disposed on an outside portion 46 of the lower portion 30 thereof. In one embodiment, the fluid course 44 is made up of an embossed area in the outside portion 46 of the lower portion 30 of the lug retaining sleeve 18. The fluid course 44 allows for more fluid to flow through a fracture, if it occurs, in the hydraulic disconnect tool 10, which creates a lower pressure drop across the BHA. The pressure drop will be noticeable for the operators of the hydraulic disconnect tool 10 which alerts them that a fracture has occurred in the hydraulic disconnect tool 10.

In another embodiment of the present disclosure, the lower portion 30 of the lug retaining sleeve 18 can also include at least one spline element 48 disposed on the outside portion 46 of the lower portion 30 of the lug retaining sleeve 18 to engage with a spline receiving area 50 disposed on an inside portion 52 of the extended portion 32 of the latch housing 14. The spline element 48 and the spline receiving area 50 cooperate to prevent the latch housing 14 from rotating independently of the lug retaining sleeve 18 and causing more damage to the hydraulic disconnect tool 10 after a fracture occurs. In one embodiment, the spline elements 48 can extend in the axial direction on the outside portion 46 of the lower portion 30 of the lug retaining sleeve 18.

The hydraulic disconnect tool 10 also includes a prop 54 that extends through the top sub 12, the lug retaining sleeve 18 and latch housing 14. The prop 54 has a fluid passageway 56 axially directed and centrally disposed therein and a depression area 58 disposed on an outside portion 60 of the prop 54. The prop 54 also has a seat 62 for engaging with a fluid blocking member 64 to prevent the flow of fluid through the hydraulic disconnect tool 10, more specifically the prop 54, and forcing the prop 54 to shift from a first position to a second position. In one embodiment, the prop 54 can include a lower portion 66 that has an outer diameter that is tapered to allow for easier assembly of the hydraulic disconnect tool 10.

When the prop 54 is in the first position in the hydraulic disconnect tool 10, the depression area 58 is disposed uphole from the radial directed opening 36 in the lug retaining sleeve 18. When the prop 54 is in the second position in the hydraulic disconnect tool 10, the depression area 58 is generally aligned with the radial directed opening 36 in the lug retaining sleeve 18 and the lug 38 can extend inward into the depression area 58 on the prop 54 and away from the depression area 40 disposed on the inside portion 42 of the latch housing 14. This allows the latch housing 14 to be released from the hydraulic disconnect tool 10 and the rest of the tools to be removed from the well leaving the bottom portion of the BHA downhole.

In yet another embodiment, the lug 38 has at least one primary prong 68 extending radially therefrom to engage at least one primary prong receiver 70 in the depression area 40 disposed in the latch housing 14. In a further embodiment, the lug 38 has at least one secondary prong 72 extending radially therefrom to engage at least one secondary prong receiver 74. The secondary prong receivers 74 provide more space than the prong receivers 70 for the primary prongs 68 and are larger than the secondary prongs 72. The primary prongs 68 directly engage the primary prong receivers 70. The secondary prongs 72 are present to engage the secondary prong receivers 74 only if the hydraulic disconnect tool 10 fractures. The secondary prong receivers 74 are larger than the secondary prongs 72 so that damage does not occur where the secondary prongs 72 engage with the secondary prong receivers 74 when the hydraulic disconnect tool 10 is subject to downhole operating conditions.

In another embodiment of the present disclosure, the primary and secondary prongs 68 and 72 include an angled portion 76 disposed on an uphole side 78 of the primary and/or secondary prongs 68 and 72 to allow the prongs 68 and 72 to more easily disengage and be removed from the prong receivers 70 and 74, which allows various parts of the hydraulic disconnect tool 10 to be more easily withdrawn from the latch housing 14 when desired.

The disclosure is also directed toward a method of using the hydraulic disconnect tool 10. The method includes pumping fluid into the and through the BHA and the hydraulic disconnect tool 10. When it is desired to separate the tools in the BHA above the hydraulic disconnect tool 10 and the tools in the BAH below the hydraulic disconnect tool 10, the fluid blocking member 64 is pumped down to engage the seat 62 disposed in the fluid passageway 56 of the prop 54 to force the prop 54 to slide from the first position to the second position. Once the prop 54 has been moved to the second position, the lug 38 will disengage from the depression area 40 on the inside of the extended portion 32 of the latch housing 14, which releases the latch housing 14 from the remaining parts of the hydraulic disconnect tool 10.

In a further embodiment of the present disclosure, the lower portion 30 of the lug retaining sleeve 18 can include multiple lugs 38, multiple spline elements 48 and multiple fluid courses 44 disposed thereon. It should be understood and appreciated that the prop 54 and the latch housing 14 should include the appropriate corresponding features to engage with the lugs 38 and spline elements 48.

Figure 5:
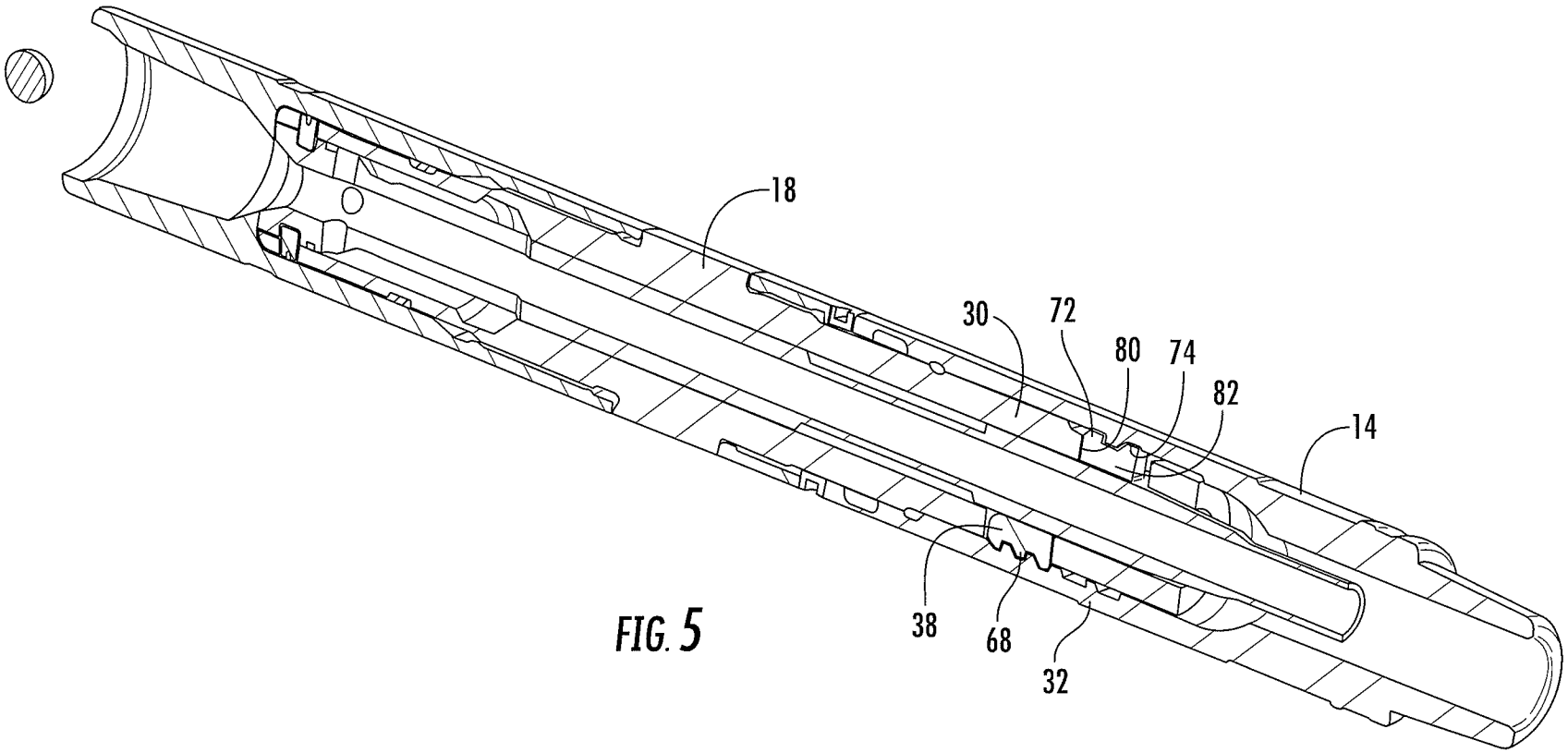
FIG. 5 is a perspective, cross-sectional view of another embodiment of a hydraulic disconnect tool constructed in accordance with the present disclosure.
Figure 6:
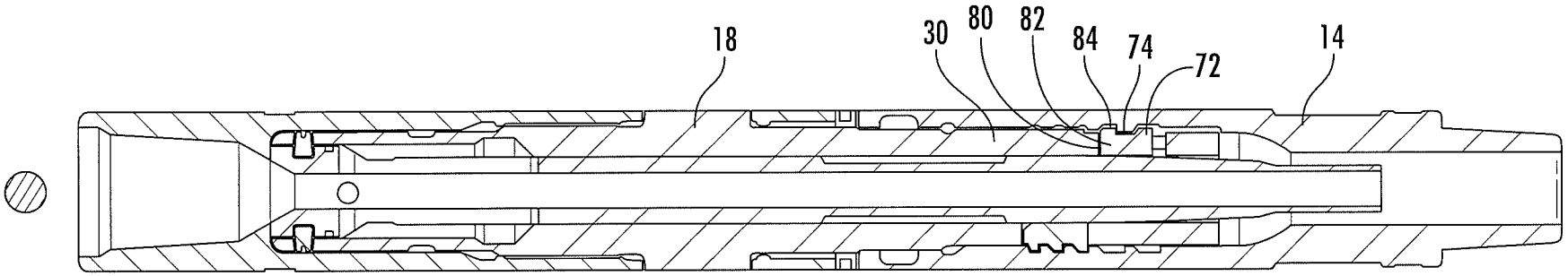
FIG. 6 is a cross-section view of the hydraulic disconnect tool of shown in FIG. 5 constructed in accordance with the present disclosure
Figure 7:
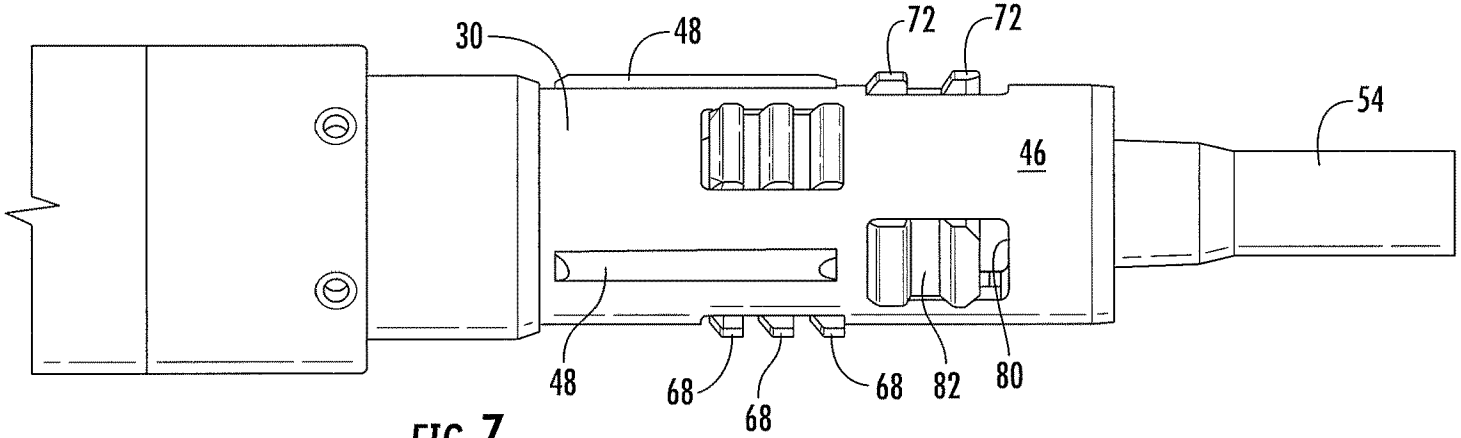
FIG. 7 is a side elevation view of a lower portion of the hydraulic disconnect tool shown in FIG. 5 constructed in accordance with the present disclosure.
Figure 8:
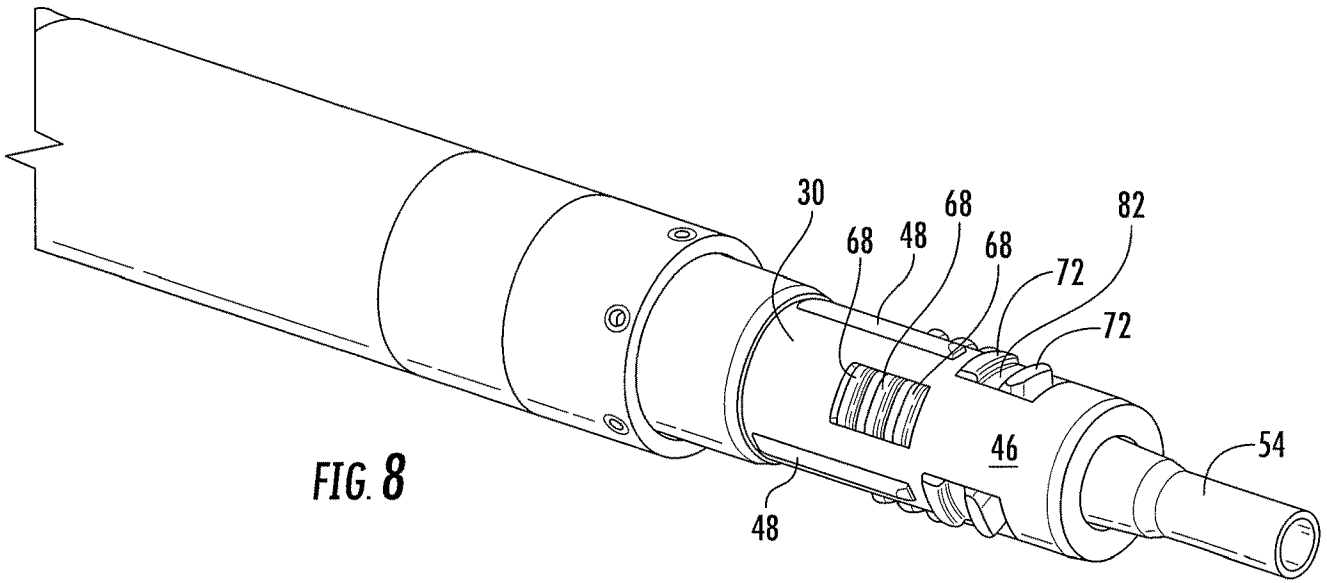
FIG. 8 is a perspective view of the lower portion of the hydraulic disconnect tool shown in FIG. 5 constructed in accordance with the present disclosure.

In yet another embodiment shown in FIGS. 5-8, the lower portion 30 of the lug retaining sleeve 18 can include a second radial directed opening 80 disposed therein for receiving a second lug 82. In this embodiment, the at least one primary prong 68 is disposed on the lug 38 and the at least one secondary prong 72 is disposed on the second lug 82. The second lug 82 can be aligned axially with the lug 38 or it can be axially offset from the lug 38. In one embodiment, the second lug 82 with the at least one secondary prong 72 disposed thereon is positioned on the lower portion 30 of the lug retaining sleeve 18 downhole from the lug 38 with the at least one primary prong 68 disposed thereon.

In this embodiment, the extended portion 32 of the latch housing 14 that accepts the lower portion 30 of the lug retaining sleeve 18 includes a second depression area 84 disposed on the inside portion 42 to engage with the second lug 82 disposed in the second radial directed opening 80 in the lug retaining sleeve 18. The secondary prong receivers 74 are disposed in the second depression area 84 to engage with the at least one secondary prong 72. Similar to what was previously described herein, secondary prongs 72 are present to engage the secondary prong receivers 74 only if the hydraulic disconnect tool 10 fractures. The secondary prong receivers 74 are larger than the secondary prongs 72 so that damage does not occur where the secondary prongs 72 engage with the secondary prong receivers 74 when the hydraulic disconnect tool 10 is subject to downhole operating conditions.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A hydraulic disconnect tool, the hydraulic disconnect tool comprising:

a lug retaining sleeve, the lug retaining sleeve having an upper portion, a base portion and a lower portion;

at least one primary prong for engaging at least one primary prong receiver disposed in a latch housing;

at least one secondary prong for selectively engaging at least one secondary prong receiver disposed in the latch housing when the at least one primary prong fails to properly engage the at least one primary prong receiver; and a prop slidably disposed inside of the at least one primary prong in the radial direction, the at least one primary prong extends from a first lug disposed in a first radial directed opening disposed in the lower portion of the lug retaining sleeve and the at least one secondary prong extends from a second lug disposed in a second radial directed opening disposed in the lower portion of the lug retaining sleeve.

2. The tool of claim 1 further comprising a preload sleeve disposed adjacent to the lug retaining sleeve and adjacent to the latch housing.

3. The tool of claim 2 wherein the preload sleeve is threadably disposed around a part of the lower portion of the lug retaining sleeve and adjacent to the base portion of the lug retaining sleeve.

4. The tool of claim 1 wherein the latch housing has a bottom sub portion for connecting the hydraulic disconnect tool to other tools and an extended sleeve portion that extends from the bottom sub portion and around the lower portion of the lug retaining sleeve having an inner portion, the inner portion of the lug retaining sleeve having a primary prong receiving area for engaging with the at least one primary prong of the first lug and a secondary prong receiving area for engaging with the at least one secondary prong of the second lug.

5. The tool of claim 1 wherein the lower portion of the lug retaining sleeve further comprises at least one spline axially disposed thereon for engagement with a spline receiving area disposed on an inner portion of the latch housing to prevent the latch housing from rotating independently of the lug retaining sleeve.

6. The tool of claim 5 wherein an outer surface of the lower portion of the lug retaining sleeve further comprises at least one fluid course axially disposed thereon.

7. The tool of claim 4 wherein each secondary prong receiver is larger than each secondary prong to allow the secondary prong to be able to slide in an axial direction within the secondary prong receiver.

8. The tool of claim 4 wherein the prop has a depression area disposed on an outer portion that is in radial alignment with the first or second radial directed opening in the lug retaining sleeve when the prop is in a second position to allow the lug to slide into and disengage the prongs from the prong receiving areas.

9. The tool of claim 8 wherein the prop includes a seat to engage with a fluid blocking member to force the prop from a first position to the second position and a lower portion that is tapered.

10. The tool of claim 1 wherein the primary and secondary prongs are angled on an uphole side of the primary and secondary prongs.

11. A method, the method comprising:

pumping fluid into and through a hydraulic disconnect tool, the hydraulic disconnect tool comprising:

a lug retaining sleeve, the lug retaining sleeve having an upper portion, a base portion and a lower portion;

at least one primary prong for engaging at least one primary prong receiver disposed in a latch housing;

at least one secondary prong for selectively engaging at least one secondary prong receiver disposed in the latch housing when the at least one primary prong fails to properly engage the at least one primary prong receiver; and a prop slidably disposed inside of the at least one primary prong in the radial direction, the at least one primary prong extends from a first lug disposed in a first radial directed opening disposed in the lower portion of the lug retaining sleeve and the at least one secondary prong extends from a second lug disposed in a second radial directed opening disposed in the lower portion of the lug retaining sleeve; and disengaging the latch housing from the lug retaining sleeve.

12. The method of claim 11 further comprising the step of shifting the prop within the lug retaining sleeve.

13. The method of claim 11 further comprising a preload sleeve disposed adjacent to the lug retaining sleeve and adjacent to the latch housing.

14. The method of claim 13 wherein the preload sleeve is threadably disposed around a part of the lower portion of the lug retaining sleeve and adjacent to the base portion of the lug retaining sleeve.

15. The method of claim 11 wherein the latch housing has a bottom sub portion for connecting the hydraulic disconnect tool to other tools and an extended sleeve portion that extends from the bottom sub portion and around the lower portion of the lug retaining sleeve having an inner portion, the inner portion of the lug retaining sleeve having a primary prong receiving area for engaging with the at least one primary prong of the first lug and a secondary prong receiving area for engaging with the at least one secondary prong of the second lug.

16. The method of claim 11 wherein the lower portion of the lug retaining sleeve further comprises at least one spline axially disposed thereon for engagement with a spline receiving area disposed on an inner portion of the latch housing to prevent the latch housing from rotating independently of the lug retaining sleeve.

17. The method of claim 11 wherein an outer surface of the lower portion of the lug retaining sleeve further comprises at least one fluid course axially disposed thereon.

18. The method of claim 15 wherein each secondary prong receiver is larger than each secondary prong to allow the secondary prong to be able to slide in an axial direction within the secondary prong receiver.

19. The method of claim 15 wherein the prop has a depression area disposed on an outer portion that is in radial alignment with the first or second radial directed opening in the lug retaining sleeve when the prop is in a second position to allow the lug to slide into and disengage the prongs from the prong receiving areas.

20. The method of claim 19 wherein the prop includes a seat to engage with a fluid blocking member to force the prop from a first position to the second position and a lower portion that is tapered.

21. The method of claim 11 wherein the primary and secondary prongs are angled on an uphole side of the primary and secondary prongs.

* * * * *